US005724773A

United States Patent [19]

Hall

[11] Patent Number: 5,724,773

[45] Date of Patent: Mar. 10, 1998

[54] BUILDING MODULE PROVIDING READILY ACCESSIBLE UTILITY CONNECTIONS

[76] Inventor: Gerald W. Hall, 141 Roswell Ave., Long Beach, Calif. 90803

[21] Appl. No.: 533,185

[22] Filed: Sep. 25, 1995

[51] Int. Cl.[6] ..... E03C 1/00; E03C 1/20; E03C 1/322; E04H 1/00

[52] U.S. Cl. ..... 52/34; 52/79.1; 52/79.12; 52/220.1; 52/220.8

[58] Field of Search ..... 52/34, 79.1, 79.12, 52/220.1, 220.8

[56] References Cited

U.S. PATENT DOCUMENTS

| | | | |
|---|---|---|---|
| 3,047,106 | 7/1962 | Callahan | 52/34 |
| 3,143,744 | 8/1964 | Greer | 52/34 X |
| 3,162,863 | 12/1964 | Wokas | 52/34 |
| 3,221,454 | 12/1965 | Togni | 52/34 X |
| 3,529,388 | 9/1970 | Wullschleger | 52/34 X |
| 3,593,469 | 7/1971 | Wall . | |
| 3,616,592 | 11/1971 | Rothman . | |
| 3,620,246 | 11/1971 | Shoquist | 52/34 X |
| 3,694,973 | 10/1972 | Unger . | |
| 3,766,574 | 10/1973 | Smid | 52/34 X |
| 3,821,818 | 7/1974 | Alosi | 52/34 X |
| 4,198,791 | 4/1980 | Kalkaslief . | |
| 4,447,996 | 5/1984 | Maurer et al. . | |
| 4,513,545 | 4/1985 | Hopkins . | |
| 4,574,533 | 3/1986 | Bigelow et al. | 52/34 |
| 4,655,011 | 4/1987 | Borges | 52/34 X |
| 4,788,802 | 12/1988 | Wokas . | |
| 5,375,380 | 12/1994 | Jones . | |

OTHER PUBLICATIONS

Photo of carrier or support for an off–the–wall water closet, manufactured by Zurn Industries.

*Primary Examiner*—Robert Canfield
*Attorney, Agent, or Firm*—L. Lee Humphries

[57] ABSTRACT

A smaller building module is comprised of two parallel frames and a water closet carrier disposed between the frames and adapted to support an off-the-floor water closet on each side of the parallel frames upon each of which a wall may be constructed. Waste conduit means, hot and cold water conduits and electrical lines extending, between the parallel frames provide ready access for connection to plumbing and electrical fixtures. Additionally, gas conduits, dryer vent conduits or other utility conduits or lines may be provided. Such building module is advantageously included in a larger building module comprised of two toilets, and one or more bath, shower, lavatory or other plumbing fixtures. Either of such building modules may be conveniently constructed in a shop and then transported and set in place on a flooring structure.

15 Claims, 8 Drawing Sheets

BUILDING MODULE PROVIDING READILY ACCESSIBLE UTILITY CONNECTIONS

This invention relates to Ser. No. 08/752445, entitled Water Closet Carrier and Waste Discharge System, inventor, Gerald W. Hall, the same inventor as herein. That application is a divisional application hereof.

This invention relates to a building module which provides readily-accessible utility connection or connections for a room, having plumbing fixtures therein, for a building, such as single or multiple family dwellings, condominiums, apartment houses, motels, hotels, offices, industrial or other kinds of buildings. Also, the module may be used to provide two rooms which are constructed adjacent each other, and installed at a building site as a single, larger building module.

Both of the smaller and the larger modules may be manufactured on a pallet or other support structure so that it may be lifted and transported to a site and there installed. Manufacture and installation in this manner enables faster production and better quality.

This invention is primarily concerned with construction of a building module which is readily installable on flooring structure. Such "flooring structure" includes any kind of support structure having suitable strength to support a building module or upon which the module is intended to be placed. "Flooring structure" includes, of course, rough flooring, slab flooring, finished or unfinished flooring or any other suitable support structure upon which a room or rooms can be built. "Flooring structure" also includes "subflooring" structure provided it is suitable, or made suitable, to receive and hold the module as part of a building.

In its simplest form, the smaller building module is comprised of two adjacent, parallel frames, each of which are approximately the size of a wall of a room. The parallel frames are comprised of vertical studs. A wall may be readily built upon each frame, each wall forming one wall of a room. "Adjacent" means that they are disposed near each other. The frames are fixedly spaced apart approximately 12 to 18 inches, preferably about 14⅛ inches.

Within the two parallel frames, there is included a water closet carrier for supporting one or more off-the-floor water closets disposed on opposite sides of the frames and the walls which may be constructed on such frames. Waste conduits, waste conduit junctions, hot and cold water conduits and other utility conduits and lines are conveniently located between the two frames. Such conduits and lines preferably extend to the ends, or near the ends, of the frames, where they are readily accessible for connection to the sewer, hot and cold water supply, electrical service supply, gas supply or other utility supply, outside the module. The bottom structure of the module lies in a plane. By "bottom of the module" is meant such bottom plane. It is to be appreciated that the module could have downward extensions, which would extend downwardly through such bottom plane, but that is not preferred. It is preferred that the bottom of the module be flat and sit flat on "flooring structure". "Flooring structure" includes "subflooring" and other structure suitable to receive and hold the module. Thus, a compact module is provided, to which all or most utility connections can readily be made during its own manufacture and during the construction of the building in which it is to be placed.

The larger building module, in its simplest form, has no floor and preferably has a ceiling although it is not required that there be a ceiling. The larger building module is adapted to be built and transported to a building site and set in place on flooring structure. A convenient size for the larger module is approximately 8½ feet wide and approximately 15 feet long. The ceiling comprises drywall screwed, riveted or otherwise attached to ceiling joists which extend across the top of the larger building module. The larger module may comprise one room, but is preferably comprised of two rooms which are toilet and bath or shower combinations. The great convenience of the larger building module is that it retains the convenience of the smaller building module. That is, the larger building module likewise has ready accessibility to all of the plumbing connections and utility connections, for plumbing, electrical and other fixtures inside or outside the building in which it is to be placed. Thus, accessibility for connections to sewer, electricity, gas, hot and cold water and dryer vent and any other desired utility is provided in such larger building module, just as in the smaller building module.

"Plumbing fixtures" includes off-the-floor water closets, lavatories, sinks, vanities, urinals, baths, showers, or combinations thereof, and any other equipment which requires water supply or waste discharge.

The smaller building module is readily incorporated in the larger building module which is preferably comprised of two rooms, with the smaller building module forming the partition, or "chase wall" as it is called in the trade, between the two rooms. Thus, a wall constructed on each side of the smaller building module forms one wall of each room. Mounting connections for off-the floor water closets, lavatories or other plumbing fixtures may readily be included on or in the smaller building module. Waste conduit connections, vent connections, hot and cold water connections, electrical connections, gas connection and dryer conduit connections for all plumbing and light fixtures are conveniently provided by the smaller building module, even when it is incorporated in a larger building module.

Vertical vents are required for each plumbing fixture. Such vertical vents may readily be disposed along the waste discharge lines and may be combined within the smaller module by nearly horizontal connections. Each vertical vent must extend at least 6 inches above the plumbing fixture before turning approximately horizontal. In the modules, vertical vents may readily be extended two, three or four feet before turning to combine with other vents.

The preferred embodiment of the larger building module has no floor and is constructed, preferably, of four walls to be set on flooring structure. Of course, the larger building module may be constructed so as to have more than four walls. Preferably and most efficiently, the two rooms of the larger building module are comprised of two toilets and two bath and shower combinations. However, only bath or shower may be included, as desired. Also, lavatory, or wash basin, vanity, medicine cabinet, mirror and light fixtures may be provided in one or both rooms, as desired. Connection to all such fixtures is provided by the smaller building module as previously discussed. Finished flooring may be completed after the module is installed. Alternatively, the module may include a floor, but that is a less efficient and less economical method of construction.

The rooms, while preferably toilets with lavatory or a wash basin, bath and shower, may otherwise be laundry rooms, kitchens, custodian rooms, rest rooms or other kinds of rooms requiring one or more waste conduits to carry away waste water and, likely, requiring cold water and electricity and, possibly, hot water. Such rooms may further require gas, dryer vent and other lines or conduits. The smaller module is readily adapted to provide the needs of all such rooms. The larger module is also readily adaptable to meet the requirements of a handicapped facility.

In the prior art, connections to waste disposal conduits are made under the flooring of a house. Such construction method is time-consuming and does not always produce the workmanlike results that can be produced in a shop. Nor does the prior art method lend itself to a production line as does the building module concept of the invention.

The smaller module, comprised of the two parallel frames, provides readily-accessible waste disposal conduit or conduits during manufacture of the smaller module and readily-accessible connections to utilities outside the smaller module after the manufacture of the smaller module is complete.

Likewise, the larger module, incorporating the smaller module as a partition, or "chase" wall, between two rooms, provides readily-accessible waste disposal conduit or conduits during manufacture of the larger module and readily accessible connections to utilities outside the larger module after the manufacture of the larger module is completed. Thus, after placement of the larger module, and during completion of the installation or thereafter, the utility conduits and lines of the modules are readily accessible for completion of the connections thereto.

The smaller and larger building modules are preferably built of steel, using steel studs connected to a bottom track and a top track, both made of steel. Such steel components are readily available and such construction is common. The steel studs and tracks are preferably 18 gauge and 3⅝ inches wide. Walls constructed of such steel studs and tracks are suitable as bearing walls. Steel studs and tracks of 25 gauge, which is lighter, may be used if bearing loads on the walls are not too great. The 18 gauge studs provide a strong wall. Wood may also be used to build the building module or parts thereof, but wood construction is much heavier than the steel construction. Plastic, other metals or other suitable materials may be used in building the modules, or parts thereof, provided strength and durability requirements are met.

The two walls which are constructed on the parallel frames form two adjacent, back-to-back walls of two rooms. In the single room module, one of the walls becomes a wall inside the room and the other wall may be an outside wall or the wall of another room.

Preferably, the two parallel frames of the smaller building module are about 14⅛ inches apart and are each manufactured using a bottom steel track and a top steel track into which are inserted the ends of steel studs on sixteen inch centers, extending front the bottom track to the top track. The studs may be adjusted in their spacing where desired, in order to fit the plumbing fixtures installed in the room. Such steel studs are fastened to the top and bottom tracks by screw means, rivets, welding or other suitably strong method. Such studs provide the means upon which to attach drywall, wallboard, plywood, tile, paneling, plasterboard or any other suitable wall-finishing means.

Placement of the two parallel frames, approximately between 12 to 18 inches apart, preferably spaced 14⅛ inches apart, conserves room space and still provides enough space between the parallel frames to locate the waste conduits, various utility service lines, hot and cold water, electrical, gas, and dryer vent, or other utilities as needed. The outer ends of the parallel frames may require some fitting to locate them between the other studs around the outside of a two-room, larger module.

Thus, the smaller module is fit between the vertical studs of most buildings which, according to standard practice, has studs built on 16-inch centers. The 16-inch on center studs may have to be adjusted in their being spaced apart so as to allow the module to fit between adjacent studs. Each parallel frame itself is built of studs approximately on 16-inch centers. The studs on the frames themselves may be adjusted, as to their being spaced apart, to accommodate plumbing fixtures and connections thereto.

A water closet carrier provides support for one or two off-the-floor water closets. The water closet carrier is box-like and is disposed between the two parallel frames. The preferred construction of the water closet carrier is 4 plates connected together. The 4 plates are a first faceplate and a second faceplate opposite the first faceplate and two side plates. The first and second faceplates may also be described as front and back plates, front and back structural means or first and second structural means. Providing structural mounting strength for the water closets is one of the basic purposes of the carrier. The other purpose of the water closet carrier is to provide for connecting to the waste discharge conduits of the off-the-floor water closets.

The water closet carrier has means for anchoring it to flooring structure upon which the module is to be placed. Such means for anchoring preferably comprise angle clips, or angle brackets, placed on first and second faceplates of the water closet carrier. However, the anchoring may be plates, rods or any other suitable anchoring means, disposed as desired, and which will provide suitable structural strength to hold the water closet carrier in place when loaded.

The angle brackets are anchored to the flooring structure by means of anchor bolts, lag screws, concrete screws, bolts, or other means for securely anchoring the angle brackets and the carrier to the flooring structure.

An off-the-floor water closet may be hung on each side of the water closet carrier. Great structural strength is provided by the carrier used in the invention. The water closets thus extend outwardly from the adjacent walls of the two rooms and are carried without any reliance on the walls for strength, because the water closet carrier is anchored to, and carried by, the floor.

The American National Standard requirements, (Standards), ASME A112.1M-1988, entitled Supports for Off-the-Floor Plumbing Fixtures for Public Use, published by The American Society of Mechanical Engineers, New York City, N.Y. requires supports for off-the-floor water closets to be a combination support (carrier) and waste fitting assemblies. There must be means to anchor the assembly to the structural floor slab and the assembly must provide any necessary gasketing for the waste line. The assembly must be able to support the fixture independently of the wall or partition, must be fully concealable in the building construction and must meet certain strength and deflection requirements. This invention includes an assembly of support and waste fittings which meets all such requirements. Lesser requirements may be acceptable in other countries, in which event, less rugged and less stringent construction rules may be used.

In review, two adjacent, parallel frames are constructed. They are rigidly spaced with respect to each other. The various utility conduits and lines extend between them. A water closet carrier is provided which is very strong and rigid, and, preferably has first and second faceplates and two side plates, all of which are steel and are welded together. The water closet carrier is placed within, or between, the parallel frames. The first faceplate is flush, or approximately flush, with a wall which is to be built on one of the parallel frames and the second faceplate is flush, or approximately flush, with a wall which is to be built on the other parallel frame. The two parallel frames form a partition between two rooms and a wall is readily built on each of the parallel frames. Each wall is a wall of its respective service room. Drywall, plywood, lathe and plaster, tile, paneling or other wall material, may be placed on each of the two parallel frames, thus constructing each wall. The water closets, if two are to be provided, are off-the-floor water closets, are placed back-to-back on each side of the walls, by connecting one water closet to the first faceplate and one water closet to the second faceplate. Each water closet is connected mechanically to its respective plate and is also connected to a waste discharge conduit extending through such plate.

The water closet carrier, in its preferred embodiment, is manufactured from four steel plates welded together as a box, having no top and bottom. It is preferred that the water closet carrier be constructed of plates of steel. The Standards requires plates to be of hot rolled carbon steel, however, cold rolled carbon steel and other steels or other metals and various alloys, or, even other materials, may be found allowable and sufficiently strong. Also, there may be situations and localities where the requirements are less stringent and, thus, materials having a lesser strength may be used. Preferably, the steel plates are ¼ inches thick, although stronger metals or materials would allow for thinner plates. Other suitable metals, plastics, hardwood or other materials having sufficient structural strength may be used to construct the water closet carrier. The strength of the material must be great because the Standards requires a minimum deflection under a load. The plates of steel should be treated with a rust inhibitor and painted, coated or lacquered to prevent rusting and corrosion.

The water closets are thus placed against their respective wall, attached to their respective faceplate, and firmly held in back-to-back relationship with respect to each other. The first and second faceplates have angle clips, or angle brackets, for firmly attaching the water closet carrier to the flooring structure upon which the module is to be placed.

A waste conduit junction is disposed between the first and second faceplates of the water closet carrier and the waste conduit junction is connected, through a hole in such plates, to the waste discharge conduits of each of the water closets.

A first waste discharge line extends between the parallel frames, slightly downward, from one side of the waste conduit junction to one end of the parallel frames, where it is conveniently accessible for connection to the sewer line or to a septic tank line. A connection to the sewer is thus provided. Such waste discharge line is thus readily accessible, to be connected to the sewer, even after the module is placed upon the flooring structure of a building. Such first waste discharge line is preferably also connected to receive the waste discharge from a bath, shower or combination of both.

All waste conduits and traps are located above the bottom of the module and, thus, above the flooring structure when the module is installed. Because of locating such conduits and traps higher, the bottoms of the bathtubs and showers must be located about 3 to 5 inches higher than is customary. Bathtub and shower modules are readily available on the market and are each installed as a unit. In this invention, a bathtub or shower module would be placed on structure, say, wooden two by fours, placed on their sides and shimmed approximately an inch higher. This leaves the side panel of the bathtub off the floor unless the manufacturer is convinced to provide an additional 4 or 5 inches of panel below the bottom of the rest of the bathtub module so that the side panel reaches the floor. Molding or other means could be used to coves or fill any gap between the bathtub side panel and the floor, if such still exists.

The other side of the waste conduit junction is connected to a second waste discharge line which extends between the parallel frames, slightly upward, to the other end of the parallel frames, where it is conveniently accessible for cleanout of the waste discharge conduits. Such second waste discharge line may also receive waste discharge from other plumbing fixtures, for example, a lavatory or wash basin, within either room.

It is to be understood that the sewer connection could be made under the module rather than at the end of the parallel frames. Such imminent, downward connection to the sewer is customary in the trade. For example, a waste discharge conduit for connection to the sewer could run downwardly below the module, from, or at, the waste conduit junction. In this invention, it is preferred that the waste discharge conduit extend to, or near to, the end of the module, where it is readily accessible for connection.

As may be seen, the waste discharge conduits are contained between the parallel frames and, thus, between the two walls which are constructed on such frames. Connections to them are easily and readily made, both during manufacture of the module and after the manufacture of the module is complete and the module is installed in place on a flooring structure for inclusion within a building.

The waste conduit junction has a vent conduit extending upwardly for running a vent through the roof. The Standards require that there be vents for all plumbing fixtures. Consequently, in order to reduce the number of vents passing through the roof, the vent conduits may readily be combined, between the two parallel frames, and within the smaller module of this invention.

The preferred embodiment of the smaller module also includes hot and cold water conduits which extend to the ends or near the ends of the parallel frames, for ready connection thereto. The hot and cold water conduits extend between the two parallel frames and have junctions to which connections are made to supply hot and cold water through the wall to the plumbing fixtures within each room.

Gas conduits, dryer vent, electrical lines and any other utility lines may also be run between the parallel frames. Such construction provides easy connection during the manufacture of the module and, later, during or after the installation of the module on the intended flooring structure.

It is, therefore, an object of this invention to provide a building module which provides readily accessible waste conduits.

It is an object of this invention to provide a building module including a bath or shower and having the waste conduit trap for the bath or shower above the bottom of the module.

It is another object of this invention to provide a building module which provides readily accessible utility connections.

Still another object of this invention is to provide a building module, having no floor and which can be placed on flooring structure.

A still further object of this invention is to provide a building module which forms two walls having most or all of the utility conduits and lines located between them.

Still a further object of this invention is to provide a building module which provides means for mounting and connecting to two off-the-floor water closets.

An object of this invention is to provide a water closet carrier adapted to be anchored to flooring structure and of sufficient strength to carry two off-the-floor water closets.

Another object of this invention is to provide a larger building module which can be set upon flooring structure and which will provide two toilets having bath or shower or both.

Still another object of this invention is to provide a larger building module having one or more baths or showers and having the traps and conduits under such one or more baths or showers above the bottom plane of the building module.

DESCRIPTION OF THE DRAWINGS

Further objects and features will be apparent from the following description and drawings in which.

DESCRIPTION

Figure 1:
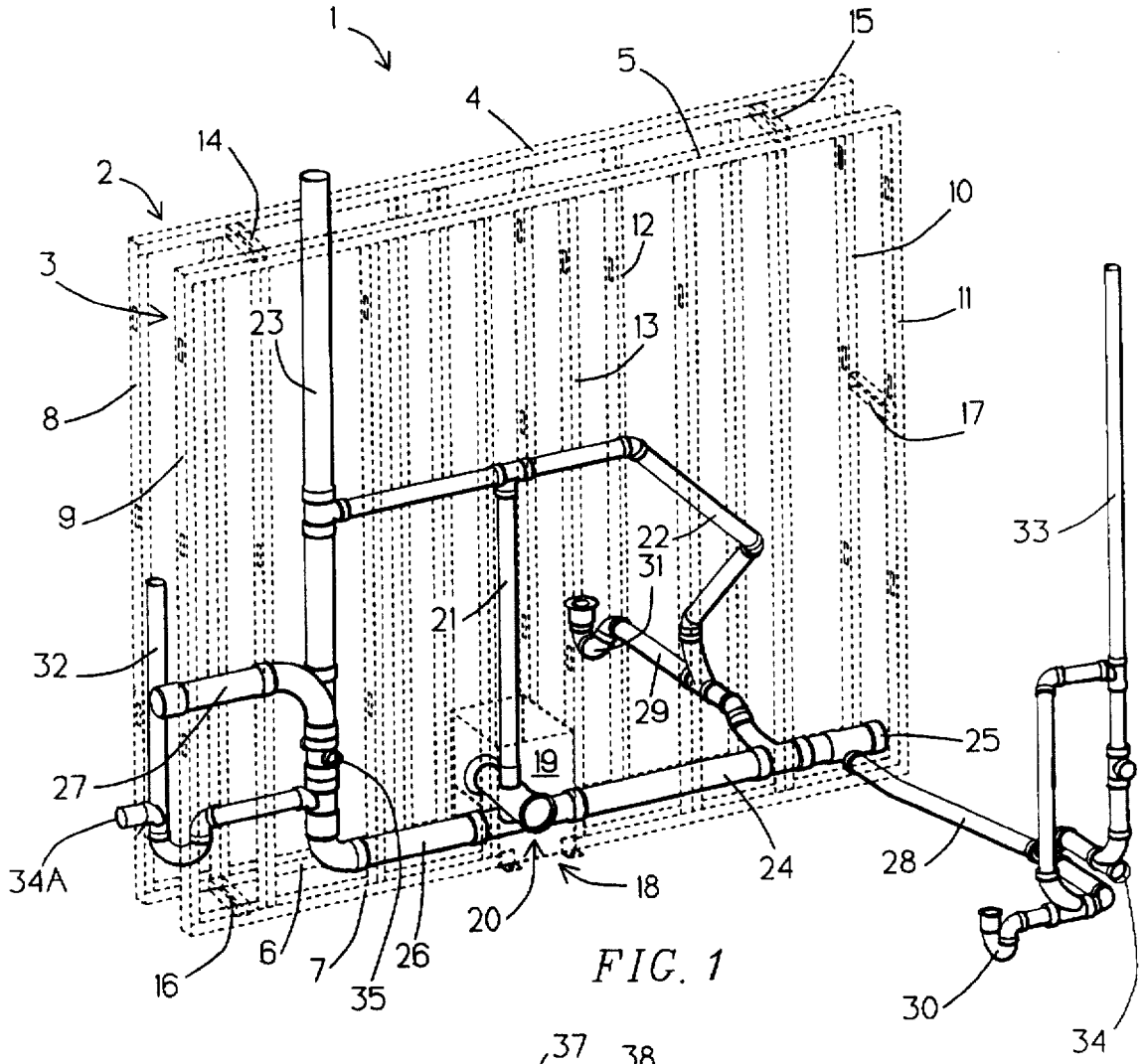
FIG. 1 is perspective of the smaller building module showing the adjacent, parallel frames in dotted lines and showing how the waste conduits for plumbing fixtures are contained between the parallel frames and how the connections are made outside the module.

FIG. 1 is perspective of the smaller building module 1 showing the adjacent, parallel frames 2 and 3 in dotted lines and showing how the waste conduits for plumbing fixtures are disposed between the parallel frames 2 and 3 and how the connections are made outside the module 1. The smaller building module is comprised of two adjacent frames, 2 and 3 having top tracks 4 and 5 and bottom tracks 6 and with end studs 8 and 9 and 10 and 11. Intermediate studs such as 12 and 13 are included between the end studs of each frame. Such intermediate studs strengthen the parallel frames and provide for a wall to be constructed on each of the parallel frames 2 and 3. The frames are held fixed apart by spacers such as 14, 15, 16 and 17. The tracks and studs are preferably made of steel.

Disposed between the parallel frames is an off-the-floor water closet carrier 18 having a front structural support means which, in this preferred embodiment, is a first faceplate 19. The carrier includes a back structural support means which, in this preferred embodiment, is a second faceplate. Also included is structural means, independent of the waste conduit junction means, for rigidly connecting the front and back structural means with respect to each other. In this preferred embodiment, such connecting structural means comprises two side plates. The construction of the off-the-floor water closet carrier 18 and the connections to the water closets are further described in connection with FIGS. 2 and 2A through 2K. Previous off-the floor-water closet carriers have used the waste conduit junction to support the front and back of the carriers. While such waste conduit junction may be used to add strength to the carrier in this invention, the strength of the carrier between the front and back of the carrier in this invention comes primarily from structural means, the two side plates, which provide substantial strength to the carrier independent of the waste conduit junction.

Figure 3:
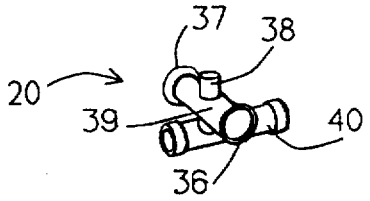
FIG. 3 shows a waste conduit junction which is typical of the kind used in the inventions.

The waste conduit junction 20, further described in FIG. 3, is disposed between the front and back structural means of the water closet carrier 18. A cross conduit 39, of the waste conduit junction 20, FIG. 3, provides for a connection to the waste discharge conduits of the off-the-floor water closets which are connected to, or are to be connected to, the front and back of the carrier 18. As may be seen, connections are made readily-accessible both during the manufacture of this smaller module and during its installation in a larger module and during or after the installation of the larger module in a building.

Also shown in FIG. 1 is a typical waste conduit system comprised of the waste conduit junction 20, and other waste conduits and fittings for attachment to plumbing fixtures. Vents are required by the Standards for each plumbing fixture having a waste conduit. Vent conduits 21, 22 and 23 are illustrative of such vent conduits. The vent conduits are customarily combined into one or two vents which extend through the roof of the building.

A main waste conduit 24 extends from waste conduit junction 20 to the end studs 10 and 11 or to near such studs. Such main waste conduit 24 drains away from waste conduit junction 29. Waste conduits are required to have a slope of at least ¼ inch per foot, for proper drainage. The end 25 of main waste conduit 24 is used to connect to the sewer line.

Another waste conduit 26 slopes toward waste conduit junction 20 and drains into it. Such waste conduit 26 is connected to vent 23, and is also connected for a cleanout access at conduit 27. A standpipe 32 provides a waste discharge conduit for a washing machine. A discharge hose from the washing machine may, for example, be inserted into the standpipe to transfer water from the washing machine to the waste discharge conduits. Vent 33 is provided for waste discharge through trap 30, from a bathtub. Fitting 34 may be connected to receive waste discharge from plumbing fixtures in other rooms, say, for example, from a sink in a kitchen, a laundry tub in a laundry room or from whatever is desired. It is to be appreciated that such kitchen might be located on the other side of the module and connected to a fitting 34A to provide its waste discharge into the waste discharge system through conduit 26.

Various waste conduits such as conduits 28 and 29 for bath or shower, or both, are readily connected to the main waste conduit 24. It is noted that traps, as required by the Standards, such as traps 30 and 31, are readily included in such waste conduit lines. Trap 30 is preferably designed to be connected to a bathtub. Trap 31 is preferably designed to be connected to a shower. If desired, the bath or shower may be located on the other side of the waste conduit junction 20 and their waste conduits would be connected to waste conduit 26, but that would require such bath or shower to be located somewhat higher than the 3 to 5 inches above the customary location of the prior art. Waste conduit 35 is disposed to be connected to a trap (not shown) for a lavatory to be placed in one of the rooms. A waste conduit is similarly disposed on the other side of vent 23 for connection to a trap for a lavatory to be placed in the other of the rooms. Thus, connections are readily made to waste conduits, vents and traps for bath, showers, lavatories, sinks and other plumbing fixtures which are desired to be included in the module.

It is noted that all waste conduits, vents and traps and, thus, all plumbing fixtures, including baths and showers, are conveniently located above the bottom level of the module. The bottom of the module sits on flooring structure, therefore, the bottom structure of the module lies in a plane. By "bottom of the module" is meant such bottom plane. It is to be appreciated that the module could have downward extensions, but that is not preferred. It is preferred that the bottom of the module be flat and sit flat on flooring structure.

Particularly, the traps for the baths and showers are located above the bottom plane of the module. This is the preferred embodiment. This is unique because it allows a complete toilet and bathroom, and, preferably, two rooms comprising each a toilet and bathroom, to be manufactured and then, as a larger building module, installed complete or nearly complete, on the flooring structure of a building, with traps and waste conduits in place. Preferably, such module has no floor and is installed on flooring structure of a building. It may, however, include flooring, but that is not the preferred manner of construction.

It is to be understood that the traps could be connected to the outside of the module without being connected to the waste conduits in the smaller module, but that is not the preferred construction. Preferably, the bath and shower traps are connected to the main waste conduit which extends between the parallel frames.

Figure 2:
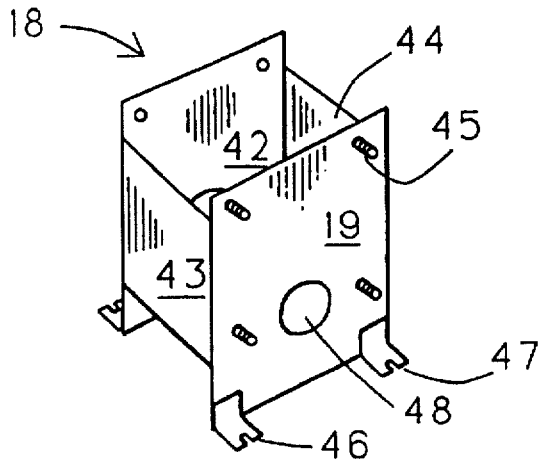
FIG. 2 is a perspective of the preferred embodiment of the off-the-floor water closet carrier comprised of first and second faceplates and two side plates.

FIG. 2 is a perspective of the preferred embodiment of the off-the-floor water closet carrier 18. This embodiment is the preferred embodiment and is comprised of first faceplate 19, second faceplate 42, and side plates 43 and 44. It further comprises four bolts, such as bolt 45 on the first faceplate 19 and, similarly four bolts (not shown) on the rear plate 42. These bolts provide for connection, or attachment, to the off-the-floor water closets, connected to the first and second faceplates 19 and 42, giving great strength to those connections, or attachments. Structural support from the flooring structure is obtained by angle clips, or angle brackets, 46 and 47, on first faceplate 19 and similar angle brackets on second faceplate 42. Such angle brackets are anchored to the flooring structure as previously explained, using anchor bolts or other means. Waste conduit junction 20 is placed between the first and second faceplates 19 and 42 and extends in the front through hole 48 in first faceplate 19 and through a similar hole in the second faceplate 42. Side plates 43 and 44 are disposed high enough to allow access and connection to the main conduit 40 of waste conduit junction 20, FIG. 3. In this embodiment, main conduit 40 lies below the bottoms of plates 43 and 44 and, in this embodiment, above the bottom of the module and the carrier.

Figure 2A:
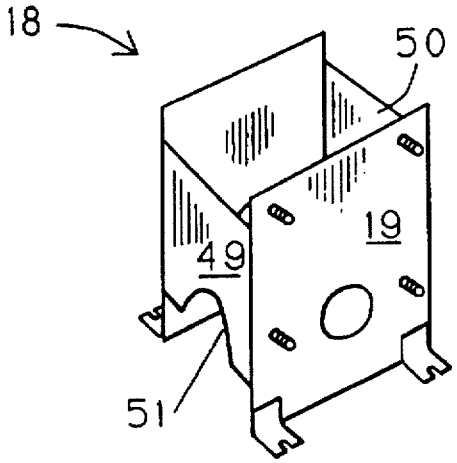
FIG. 2A is an off-the-floor water closet carrier, showing alternative side plates.

FIG. 2A is an off-the-floor water closet carrier 18, showing alternative side plates. Such side plates 49 and 50 have recesses, such as recess 51 in plate 49, to allow access and connection to main conduit 40 of waste conduit junction 20.

Figure 2B:
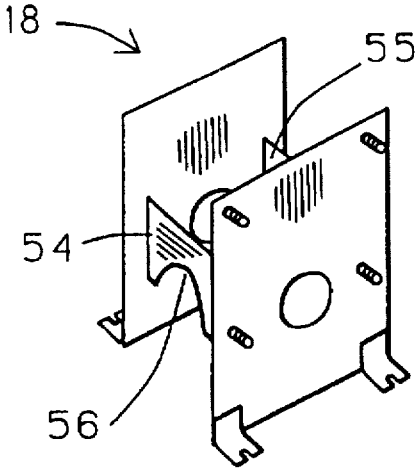
FIG. 2B is another embodiment of FIG. 2A, showing the side plates indented from the sides of the carrier.

FIG. 2B is another embodiment of the water closet carrier 18 of FIG. 2A, showing the side plates 54 and 55 indented from the sides of the carrier 18. Such side plates have recesses, such as recess 56 in side plate 54.

Figure 2C:
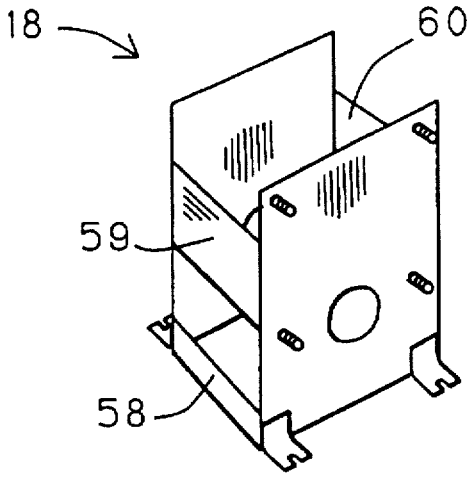
FIG. 2C is an off-the-floor water closet carrier showing side straps or plates that are not so wide as in FIG. 2A.

FIG. 2C is an off-the-floor water closet carrier 18 showing side straps, or plates, 58, 59 and 60, that are not so wide as in FIG. 2A.

Figure 2D:
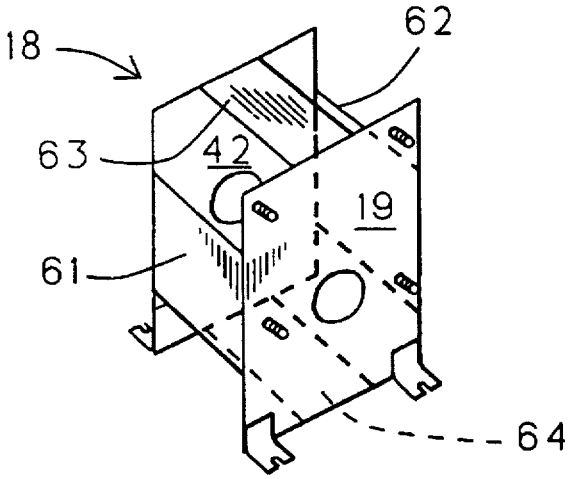
FIG. 2D is an off-the-floor water closet carrier having two side plates and a top plate.

FIG. 2D is an off-the-floor water closet carrier 18 having two side plates 61 and 62 and a top plate 63. It may, alternately, have bottom plate 64 in addition to top plate 63 or in place of top plate 63.

Figure 2E:
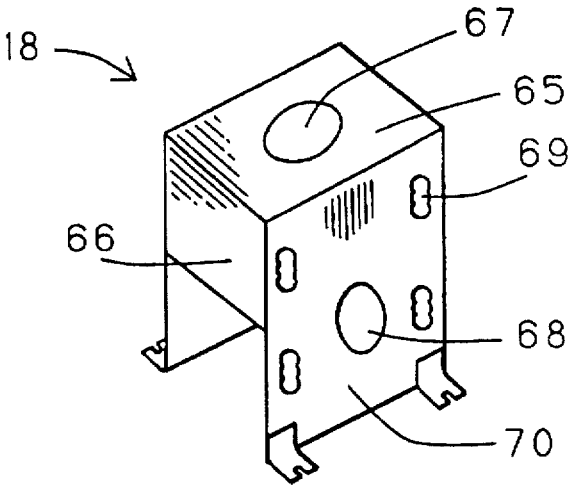
FIG. 2E is an adjustable off-the-floor water closet carrier having a top plate and two side plates.

FIG. 2E is an adjustable off-the-floor water closet carrier 18 having a top plate 65 and two side plates, such as side plate 66. Top plate 65 may have a hole, such as hole 67, to allow a vent conduit to pass through.

FIG. 2E also illustrates how adjustability may be obtained from any of the carriers, both as to connections to the off-the-floor water closets and as to the waste conduit junction 18. Holes, such as hole 69, in the first faceplate 70, permit bolts to be adjustably located on first faceplate 70. Further, hole 68 in first faceplate 70 is sufficiently elongated, vertically, to allow adjustability of the connection between the waste conduit junction 18 and the waste discharge conduit of the off-the-floor water closet.

Figure 2F:
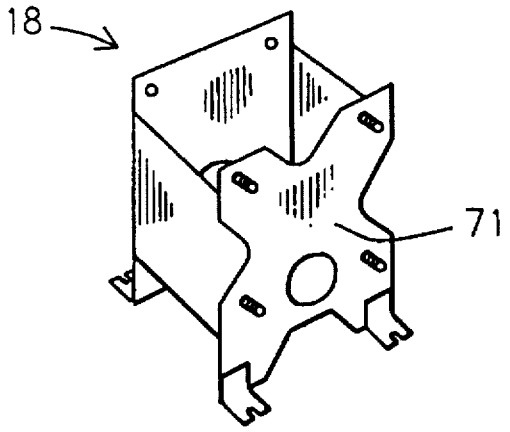
FIG. 2F is an off-the-floor water closet carrier in which the front support structure, rather than being a faceplate, is comprised of a cruciform or "x" shape.

FIG. 2F is an off-the-floor water closet carrier 18 in which the front support structure means 71 is comprised of a cruciform or "x" shape. Such may be constructed out of a single piece of material or out of two crossed pieces which are welded or otherwise fixed in place with respect to each other.

Figure 2G:
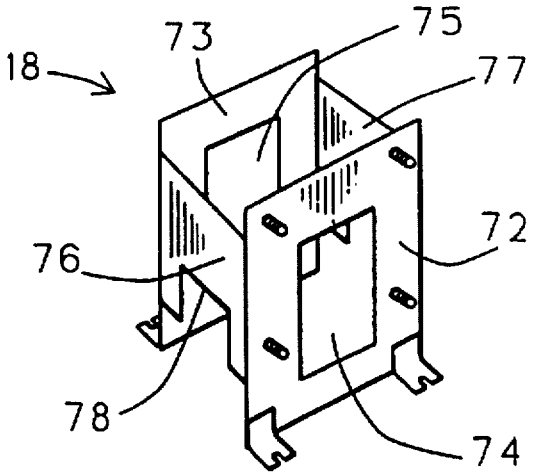
FIG. 2G is an off-the-floor water closet carrier in which the first and second faceplates have rectangular holes and the side plates have rectangular cutouts.

FIG. 2G is an off-the-floor water closet carrier 18 in which the first and second faceplates 72 and 73 have rectangular holes 74 and 75. Side plates 76 and 77 may have rectangular or other cutouts as shown at 78.

Figure 2H:
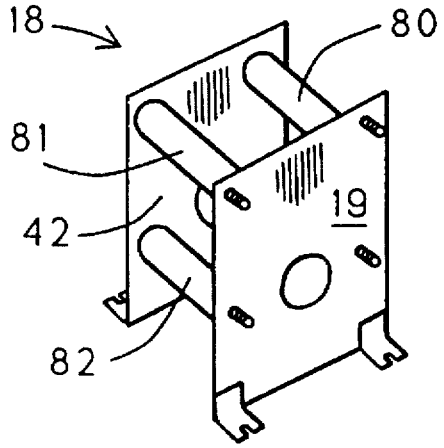
FIG. 2H shows the first and second faceplates of an off-the-floor water closet carrier having tubular supports between first and second faceplates.

FIG. 2H shows the first and second faceplates 19 and 42 of an off-the-floor water closet carrier 18 having tubular supports, such as tubular supports 80, 81 and 82, between first and second faceplates 19 and 42. Such tubular supports are connected to plates 19 and 42 by welding or other suitable means.

Figure 2I:
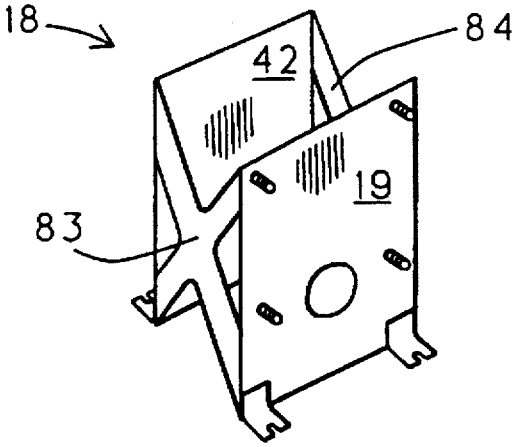
FIG. 2I shows first and second faceplates supported with respect to each other by cruciform or "x" shaped structural material.

FIG. 2I shows front and back structural means which, in this instance, is comprised of plates 19 and 42, supported with respect to each other by cruciform or "x" shaped structural material, such as "x" shaped elements 83 and 84.

Figure 2J:
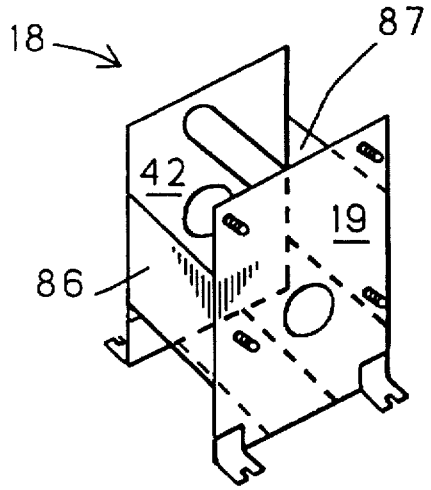
FIG. 2J shows a combination of tubular support structure and plate structure connecting first and second faceplates of the carrier of an off-the-floor water closet.

FIG. 2J shows a combination of tubular support structure 85 and plate structures 86 and 87, connecting first and second faceplates 19 and 42 of the carrier 18 of an off-the-floor water closet.

Figure 2K:
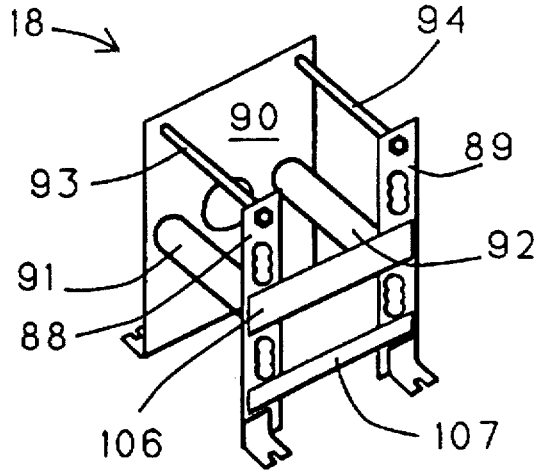
FIG. 2K shows the front support structure as comprised of two columns. In this embodiment, two tubular means and two rods are connecting such front support structure to the back support structure.

FIG. 2K shows the front support structure means as comprised of two columns 88 and 89. In this embodiment, two tubular means 91 and 92 and two rods 93 and 94 connect such front support structures 88 and 89 to the back support structure 90. Front plates, or straps, 106 and 107 connect columns 88 and 89 so as to strengthen them.

FIG. 3 shows a waste conduit junction 20 which is typical of the kind used in this invention. It is readily available as are other shapes and forms of such a waste conduit junction. It comprises a cross conduit 39 having an upwardly extending conduit 38 which is commonly used as a vent conduit. Front fitting 36 is adapted to be just forward of the first faceplate 19 of the water closet carrier 18, FIG. 1, and is attached to the waste discharge conduit of the water closet. A similar back fitting 37 attaches to the waste discharge conduit of a water closet attached to the second faceplate 42, FIG. 2, on the other side of the water closet carrier 18, FIG. 1. A main discharge waste conduit 40 is connected on both ends to main waste discharge conduits. Waste conduit junctions and connection fittings are commonly available and used in the trade as are the waste conduits.

Figure 4:
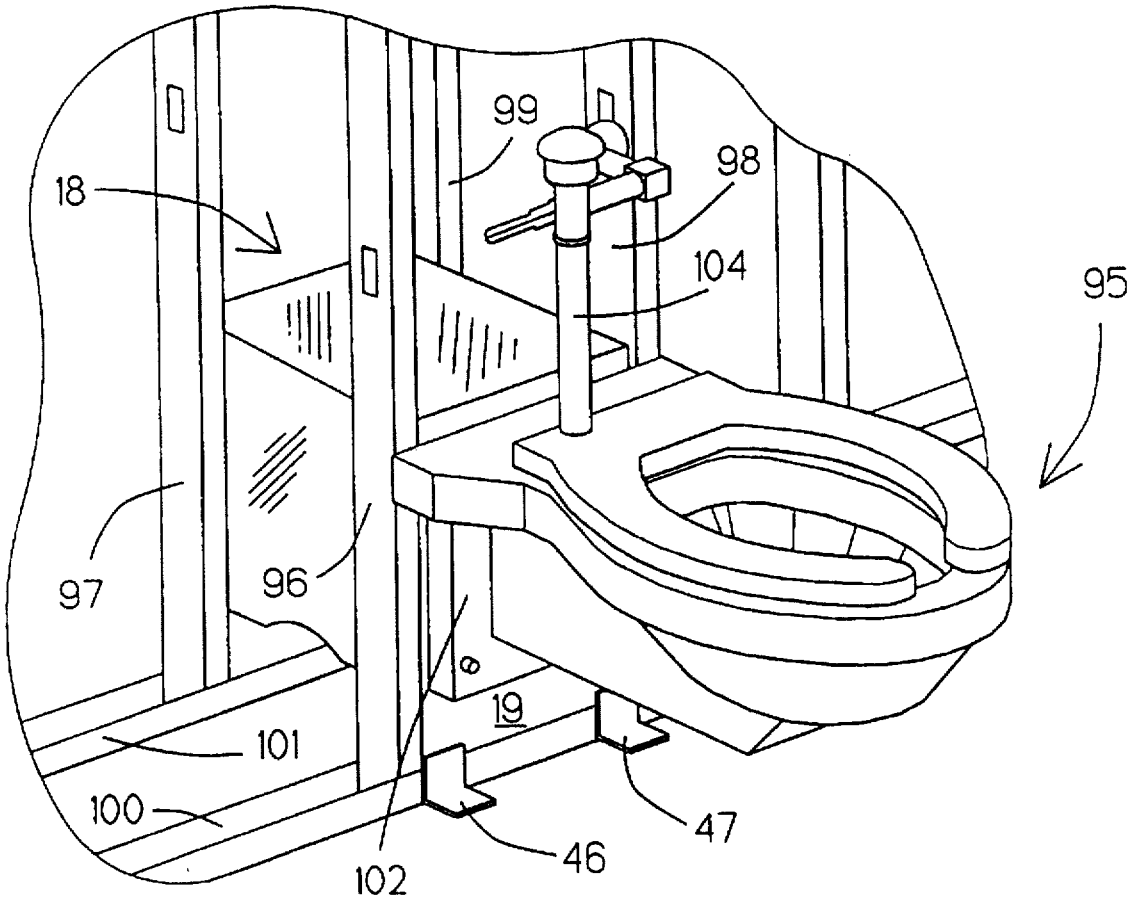
FIG. 4 shows an off-the-floor water closet connected to, and carried by, the carrier which is mounted between the studs of the smaller module.

FIG. 4 shows an off-the-floor water closet 95 connected to, and carried by, the carrier 18 which is mounted between the studs 96, 97, 98 and 99 of the smaller module. The studs shown are steel studs and they sit in bottom tracks 100 and 101, which are likewise steel, to which they are riveted, screwed, welded or otherwise firmly attached. It is noted that first faceplate 19 of carrier 18 sits inside track 100, but the angle brackets 46 and 47 extend over the track 100 for ready anchoring to the flooring structure which is not shown and, of course, which is not ordinarily included in either of the modules of the invention. Again, the smaller module 1 or the larger module 110 preferably have no floor, but, after being manufactured, the modules are ready to be placed on flooring structure.

As can be seen, the off-the-floor water closet has a plate 102 which is adapted to be bolted to a water closet carrier such as carrier 18. The water closet has a waste discharge conduit (not shown which passes through such plate 102 and is connected to a fitting such as that shown as fitting 36 in FIG. 3, which, of course, extends through first faceplate 19 of water closet carrier 18.

A similar off-the-floor water closet may be attached to the back side, or far side, of the water closet carrier 18, in the same manner at described in connection with water closet 95.

The water closet 95 receives a cold water supply through input conduit 104 which is readily connected to a cold water conduit which extends outward from between the parallel frames.

Figure 5:
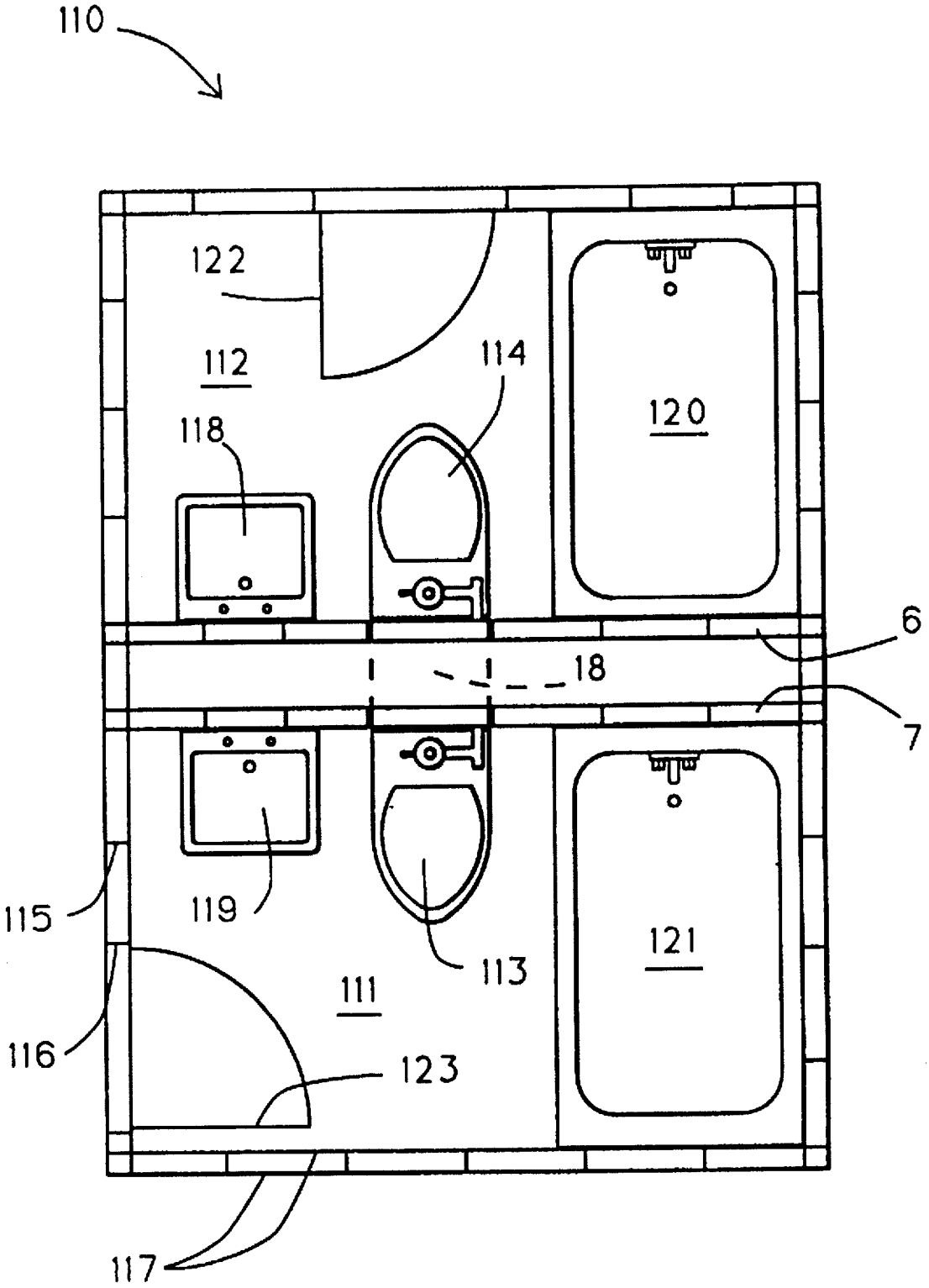
FIG. 5 is a plan view of the larger module, comprising two toilets having back-to-back water closets both carried by a single water closet carrier.

FIG. 5 is a plan view of a preferred embodiment of the larger module 110, comprising two toilets 111 and 112 having back-to-back water closets 113 and 114, both carried by a single water closet carrier 18 shown by dotted lines. The waste conduits and other utilities that extend between the parallel frames are not shown. The module is preferably built, around the outside, of steel, such as of steel studs 115 and 116 and bottom tracks, such as steel track 117. The steel studs extend upwardly and terminate in top steel tracks which are shown and described further in connection with FIG. 6. Lavatories 118 and 119 may be included, as may baths, such as baths 120 and 121 or showers or combinations of bath and showers. Of course, the hot and cold water for the two rooms are provided by water conduits disposed in the smaller module 1. Such water conduits are disposed between the parallel frames of smaller module 1 as will be discussed later in connection with FIG. 8. The bottom tracks 6 and 7 of the parallel frames 2 and 3, FIG. 1, are shown in FIG. 5.

The fresh water conduits, as well as the waste water conduits, are disposed between the two rooms, between the two parallel frames. The rooms each have a door, shown at 122 and 123.

If one or both of the rooms is to be a handicapped toilet facility, the door opening would be 36 inches and there would be no bath in the room. The water closet, and its associated carrier, would be located where bath 121 is shown. The center line of the water closet would be located 18 inches from the wall. A handrail would be securely attached to the wall. A urinal could also be located conveniently within the handicapped toilet, say, where toilet 113 is shown.

Figure 6:
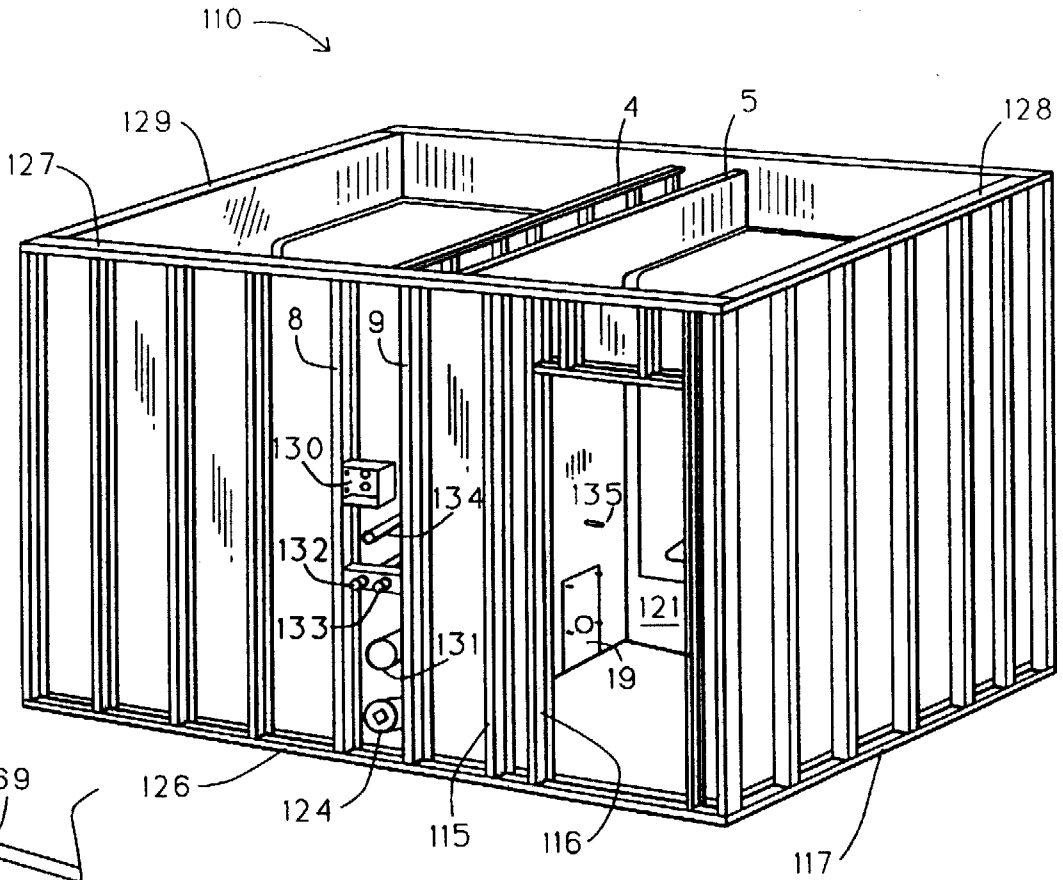
FIG. 6 is a perspective of the larger module, looking into one of the two rooms of the module.

FIG. 6 is a perspective of the larger module 110, looking into one of the two rooms of the module 110. The steel studs, such as steel studs 115 and 116, top tracks, such as tracks 127 and 129 and bottom tracks, such as tracks 117 and 126, are located around the outside of the module 110 and provide the basic structure of the module. Each of the four outside walls of the larger module 110 may be manufactured and then fit together to form the outside of the module. So, also may the parallel frames 2 and 3 of the smaller module 1 be manufactured and fit to each other and then fit within the larger module.

The steel studs rest in and are attached to steel bottom tracks such as tracks 117 and 126. The top of the steel studs fit into steel top tracks, such as tracks 127, 128 and 129. The top tracks 4 and 5 of the smaller building module are shown, extending across the middle of the larger building module 110 and provide the top of a partition, or "chase" wall between the two rooms of the larger module 110. It has been found convenient to build the larger module to have a ceiling that is 7 feet 6 inches high rather than the customary 8 feet. Buildings customarily have 8-foot ceilings. Such height of 7 feet 6 inches permits the larger module to fit within standard 8 foot ceiling height structures of building in which it is to fit.

As explained before, the steel studs of the construction provide a ready means for building a wall thereon, both inside and outside the module, using drywall, plywood, paneling, plasterboard or any suitable wall material. Using drywall screwed to the steel studs has been found to be a particularly easy and convenient way to manufacture the walls of the modules. Preferably, a ceiling is similarly constructed and fit to the larger module.

Cleanout access 124 provides external access to cleaning out the waste conduit lines. Such cleanout access may be located elsewhere if desired.

Electrical junction box 130 is shown attached to stud 8. The electrical supply lines, to light, fan, outlets, or other electrical fixtures, conveniently extend within the smaller module to any desired location. Junction box 130 provides a convenient and easy access to connect the module to the electrical supply lines.

A dryer vent conduit 131 is also accessible for connection to a dryer. The conduit 131 extends through the module to the other side and, therefore, could he connected on either side of the module to a dryer. If the dryer is on the far side of the module 110, the dryer vent conduit 131 serves as an outside exhaust port for dryer air.

Hot and cold water supply is connected to conduits 132 and 133. The hot and cold water supply conduits also extend through and within the smaller module to desired locations for connection through the smaller module to lavatory, sink, bath, water closet or other plumbing fixture.

Gas conduit 134 is readily accessible for connection to gas supply. Such gas conduit extends within the smaller module to wherever needed within the larger module, or, possibly, to a dryer or water heater, located on the other side of the larger module.

As previously mentioned, the larger module 110 is preferably manufactured without a floor. Preferably it has two baths, or one bath and one shower, in the two rooms. Of course, any combination of showers and baths may be constructed. The first faceplate 19 of the water closet carrier is ready to receive and be connected to an off-the-floor water closet. Both mechanical connection and waste conduit connection is made to the water closet at plate 19. A cold water connection 135 for the water closet is disposed nearby the plate 19.

Windows may be located in either or both of the rooms of the larger module. For example, windows (not shown) may be located above the bath or shower, as desired.

Figure 6A:
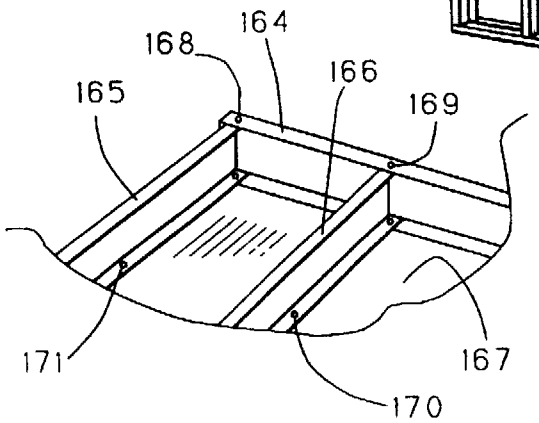
FIG. 6A is a cutaway view showing construction of the ceiling for the larger module.

FIG. 6A is a cutaway view showing construction of the ceiling for the larger module. The ceiling may readily be constructed in place, on the larger module, or after installation of the larger module on flooring structure. However, the ceiling is preferably constructed separately, much the same as the walls and assembled with the walls to make a larger building module 110. If the ceiling is completed first, the drywall panels inside the rooms of the larger module are easily fit up against the drywall ceiling as the walls of the rooms are completed.

As explained previously, the ceiling of the larger module 110 is preferably located at 7 foot 6 inches in height. It is noted from FIG. 6 that top tracks 4 and 5 are located approximately 6 inches below the top of the module. This allows a ceiling to be placed on tracks 4 and 5 and still leave a clearance so that the entire module, including ceiling, can be fit within a building having ceilings which are 8 feet high.

In FIG. 6A, an end track 164 receives studs such as studs 165 and 166. Another end track (not shown) is connected on the opposite ends of such studs, with the two tracks being the opposing sides of the ceiling frame. The other two sides of the ceiling frame are made by end stud 165 and a similar end stud (not shown) on the opposite side of the ceiling frame from end stud 165.

Such two tracks, together with the two end studs form a ceiling frame. Within the frame are additional studs on 16-inch centers between and parallel to the end studs. Such tracks and studs provide a framework for the ceiling on which is hung a ceiling material, such as drywall 167. The drywall 167 or other ceiling material, may be readily screwed to such studs as shown by screws 168, 169, 170 and 171. The completed ceiling is then placed with the studs running crosswise of the steel tracks 4 and 5 and with the ceiling resting on tracks 4 and 5. It may be seen with such construction, the ceiling is located downwardly from the top tracks 127, 128 and 129 of the module 110.

The ceiling not only rests on top tracks 4 and 5 but is also screwed thereto. The ceiling framework is also screwed to the vertical studs of the module 110. That is, there are screws which pass through the two end studs of the ceiling framework, only end stud 165 being shown in FIG. 6A, into vertical studs. Also, there are screws which pass through the two end tracks of the ceiling, only end track 164 being shown in FIG. 6A, into vertical studs of the module, such as vertical studs 115 and 116.

Of course, the ceiling may be constructed either at the top or on the top of the module, but what has been described is the preferred embodiment.

The ceiling may or may not be included with the larger module, as desired. Preferably, it is included and the walls inside the module are also preferably, completed with drywall or other material or materials as desired.

Figure 7:
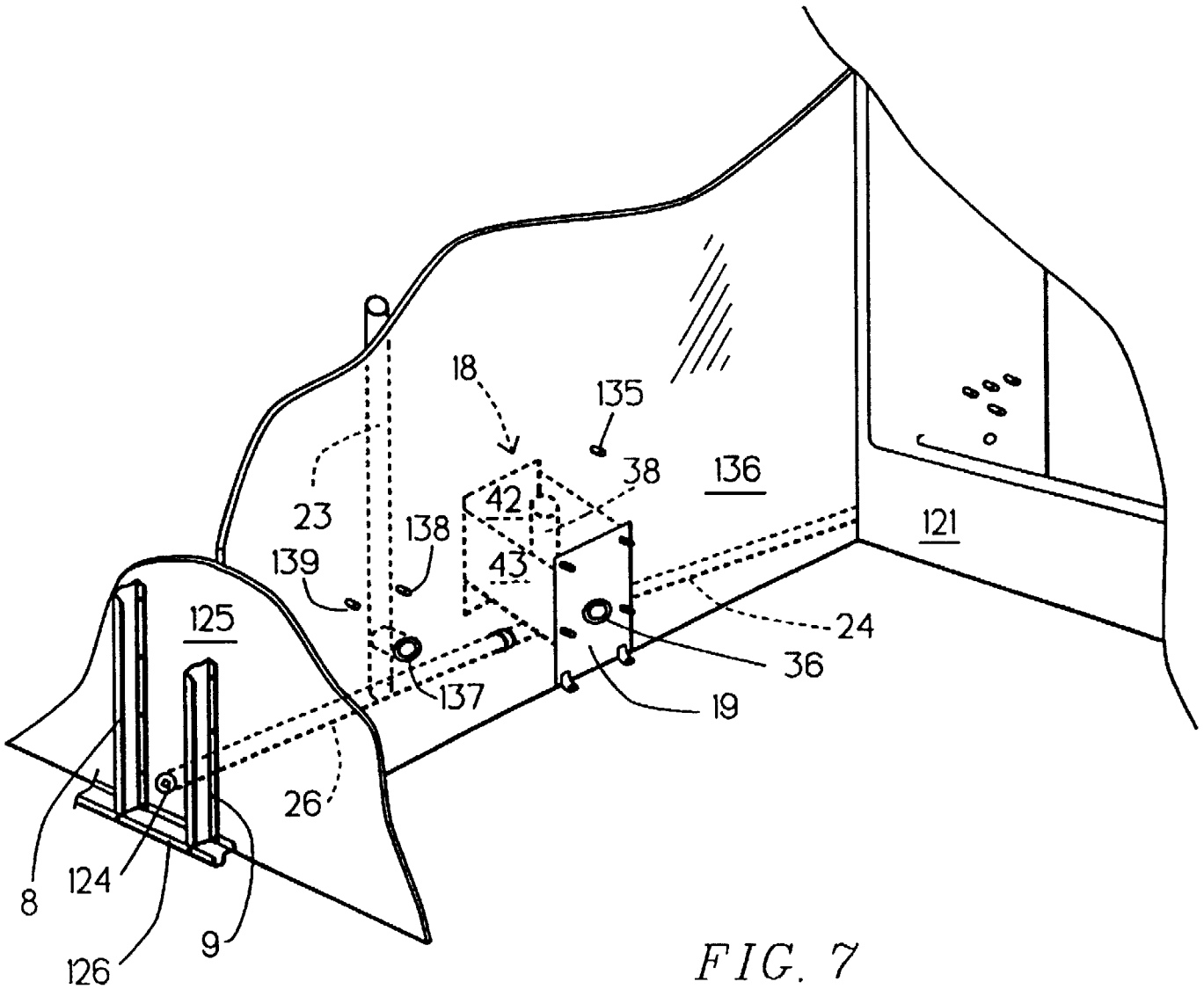
FIG. 7 is a broken partial view of one room of a larger module, showing the water closet carrier in dotted lines, a bath and shower combination and hookup connections for a lavatory.

FIG. 7 is a broken partial view of one room of a larger module, showing the water closet carrier 18 in dotted lines, a bath and shower combination 121 and hookup connections for a lavatory. Cold water conduit 135 extends out through wall 136 to provide water to the water closet to be connection to the water closet carrier 18. The cold water supply, of course, extends behind wall 136 to provide cold water where needed within the room. Waste conduit 26 extends from cleanout access 124 to a fitting which connects it to the waste conduit junction located at the carrier 18. Main waste conduit 24 extends from the other side of the waste conduit junction to the end of the module, or near the end of the module, where it is adapted to be connected to the sewer or to conduits leading to the sewer. Intermediate the length of waste conduit 26 is a vent conduit 23 and also a waste fitting 137 for fitting to a lavatory's waste conduit. Cold and hot water conduits 138 and 139 extend through wall 136 to provide hot and cold water to the lavatory.

As may be seen in FIG. 7, waste conduit 36 is made available at the first faceplate 19 for connection to the waste discharge conduit of an off-the-floor water closet.

FIG. 7 also illustrates the disposition of steel studs such as studs 8 and 9, within steel bottom track 126. Such studs are connected to such tracks by screws, rivets or welding. Also, the drywalls 125 and 136 are connected to steel studs by screws, rivets or other suitable means.

Figure 8:
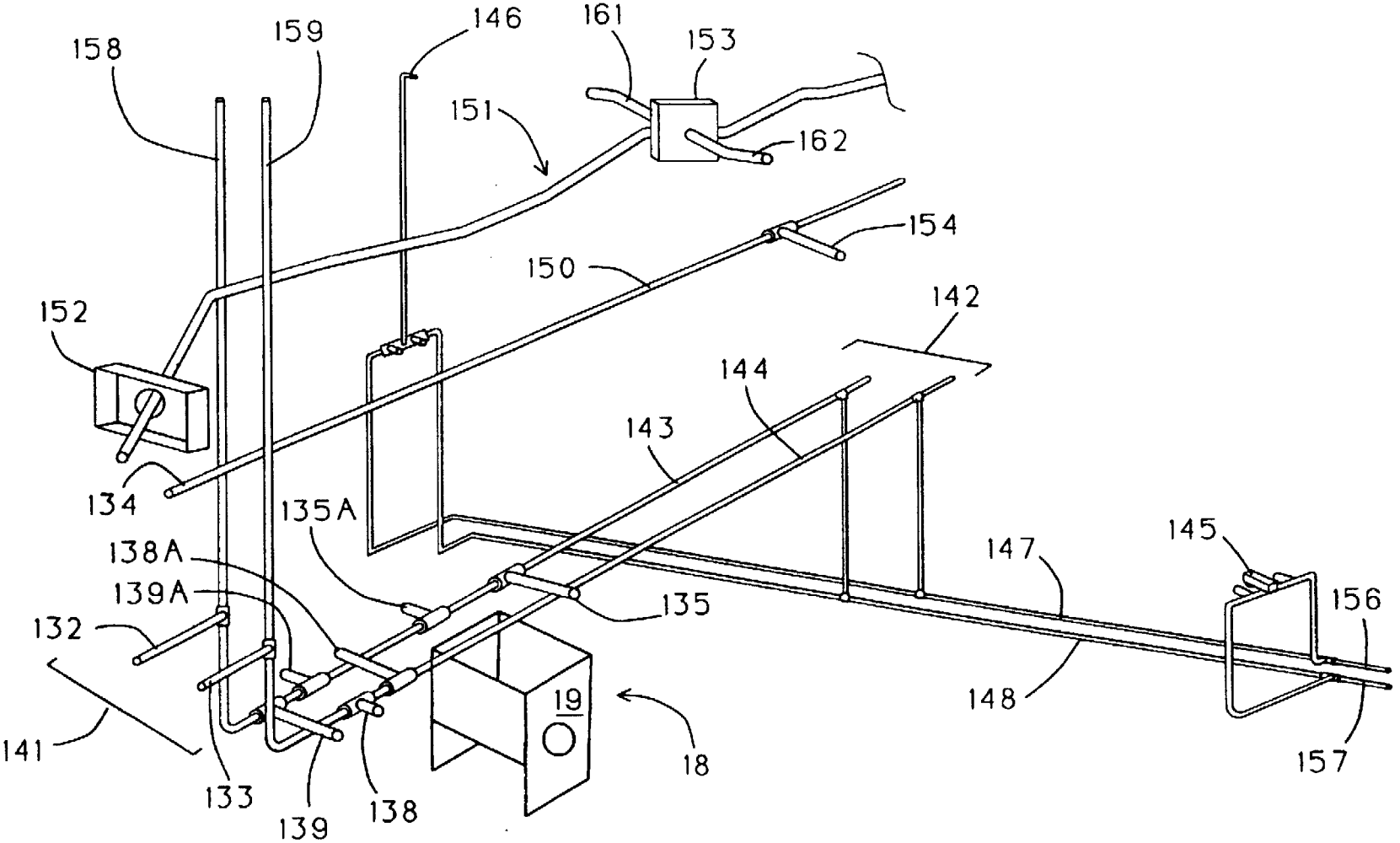
FIG. 8 is a skeleton sketch of the utility conduits and lines of the modules.

FIG. 8 is a skeleton sketch of the utility conduits and lines extending between the parallel frames of the smaller module 1. Also shown are the hot and cold water system of the larger module 110, providing hot and cold water outlets to both a bath and a shower as well as to two lavatories, vanities, sinks or the like. Cold water outlets are also provided for two water closets. The input hot and cold water connection may be made at either end 141 or 142 of the water supply system. Assuming the hot and cold water supply are connected to end 141, then the conduits 132 and 133 are those viewed also in FIG. 6. The other end 142 may be used to connect hot arid cold water to additional fixtures, say, for laundry, kitchen, additional rooms or to meet other needs. Main cold water conduit 143 and main hot water conduit 144 extend through the smaller module 1, between the parallel frames 2 and 3, FIG. 1. A bath tub outlet 145 receives hot water from hot water conduit 144 through a transverse hot water conduit 147 and receives cold water from cold water conduit 143 through a transverse cold water conduit 148. A shower outlet 146 likewise receives hot water from transverse hot water conduit 147 and receives cold water from transverse cold water conduit 148. Such transverse conduits 147 and 148 are conveniently located adjacent the bottom of the steel studs forming the wall of the module 110.

Additional water supply outlets 158 and 159 may be connected to provide hot and cold water to the next floor upward, or, may be used to connect to the input water supply if that is where such supply is located. Water may be further supplied to an adjoining kitchen by conduits 156 and 157. It is noted that any of outlets 156, 157, 158, 159 and those shown at ends 141 and 142 may be connected to receive water supply or, alternatively, may be connected to provide water supply to a kitchen, laundry, custodial closet or other room.

Cold water for the water closets in each room are provided by cold water outlets 135 and 135A. Hot water for a lavatory, sink or other plumbing fixtures in each room are provided by hot water outlets 138 and 138A. Cold water for such lavatory, sink or other plumbing fixtures in each room is provided by cold water out lets 139 and 139A.

The approximate relative position of the water conduits and the water closet carrier 18 is shown in FIG. 8. It would be possible, of course, to run the water supply conduits higher or lower, even so as to pass through the water closet carrier. But that would not be as convenient.

Also shown in FIG. 8 is gas conduit 150 having an outlet 154, located as desired. Gas conduit 134, for connecting to the supply source, may also be viewed in FIG. 6. Gas conduit 150 extends between the parallel frames of the smaller let module 1, illustrated in FIG. 1. The gas conduit 150 may not have any outlet in the smaller module 1 or the larger module 110 and may simply provide a gas supply as needed on one side of the modules or the other. It is to be realized that the gas conduit extends between the two parallel frames 2 and 3, FIG. 1 and may be located high or low, as desired and as convenient, between such frames.

Further shown in FIG. 8 is an electrical conduit 151 which may be conduit, flexible cable, Romex or any other electrical supply lines or conduits, as may be acceptable or required by applicable standards or codes. Typical junction boxes are illustrated at 152 and 153, but such may be located as needed. They are conveniently attached to the steel studs or to the tracks if desired. Conduits 161 and 162 allow for connection to, for example, overhead light fixtures or light fixtures above mirrors or vanities which may be in each room. As with the gas conduit, the electrical conduit 151 may be located high or low and directed as needed. It, too, extends between the two parallel frames, 2 and 3, FIG. 1, or is often threaded through existing holes in the steel studs.

Although specific embodiments and certain structural arrangements have been illustrated and described herein, it will be clear to those skilled in the art that various other modifications and embodiments may be made incorporating the spirit and scope of the underlying inventive concepts and that the same are not limited to the particular forms herein shown and described except insofar as determined by the scope of the appended claims.

I claim:

1. A building module comprising two adjacent, parallel frames comprised of vertical studs, said frames each being approximately the size of the wall of a room, said frames held fixedly spaced apart, an off-the-floor water closet comprising waste discharge conduit means, waste conduit junction means, water closet carrier means disposed between said parallel frames, said water closet carrier means being comprised of front and back structural means, at least one of said front and back structural means connected to provide support for said off-the-floor water closet means, said water closet carrier means adapted to receive said waste conduit junction means within said water closet carrier means, and wherein said waste conduit junction means is connected to said waste discharge conduit means of said off-the-floor water closet, structural means independent of said waste conduit junction means rigidly connecting said front and back structural means with respect to each other, and wherein said independent structural means rigidly holds said front and back structural means apart, with respect to each other, independently of said vertical studs and wherein said module comprises a plurality of walls forming one or more rooms in said module, and wherein at least said front structural means is comprised of a plate and wherein said module has no floor.

2. A building module comprising two adjacent, parallel frames comprised of vertical studs, said frames each being approximately the size of the wall of a room, said frames held fixedly spaced apart, an off-the-floor water closet comprising waste discharge conduit means, waste conduit junction means, water closet carrier means disposed between said parallel frames, said water closet carrier means being comprised of front and back structural means, at least one of said front and back structural means connected to provide support for said off-the-floor water closet means, said water closet carrier means adapted to receive said waste conduit junction means within said water closet carrier means, and wherein said waste conduit junction means is connected to said waste discharge conduit means of said off-the-floor water closet, structural means independent of said waste conduit junction means rigidly connecting said front and back structural means with respect to each other, and wherein said independent structural means rigidly holds said front and back structural means apart, with respect to each other, independently of said vertical studs and wherein said front and back structural means are each comprised of a plate and wherein is included means for anchoring said plates directly to flooring structure and wherein each of said plates has a hole through which said waste conduit junction means is connected to said waste discharge conduit means of said off-the-floor water closet.

3. A building module comprising two adjacent, parallel frames comprised of vertical studs, said frames each being approximately the size of the wall of a room, said frames held fixedly spaced apart, an off-the-floor water closet comprising waste discharge conduit means, waste conduit junction means, water closet carrier means disposed between said parallel frames, said water closet carrier means being comprised of front and back structural means, at least one of said front and back structural means connected to provide support for said off-the-floor water closet means, said water closet carrier means adapted to receive said waste conduit junction means within said water closet carrier means, and wherein said waste conduit junction means is connected to said waste discharge conduit means of said off-the-floor water closet, structural means independent of said waste conduit junction means rigidly connecting said front and back structural means with respect to each other, and wherein said independent structural means rigidly holds said front and back structural means apart, with respect to each other, independently of said vertical studs and wherein said module has one or more rooms, and wherein is included a first main waste conduit means connected to said waste conduit junction means, said first main waste conduit means running approximately parallel to said parallel frames and within said frames and sloping downwardly from said junction to one of the ends of said parallel frames, said first main waste conduit means adapted to be connected to a sewer line, and wherein is included a second main waste conduit means connected to said waste conduit junction means, said second main waste conduit means running approximately parallel to said parallel frames and within said frames in the opposite direction from said first main waste conduit means, said second main waste conduit means sloping upwardly from said waste conduit junction means, said second main waste conduit means providing access means for cleaning said waste conduit junction means and said second main waste conduit means and wherein said module has no floor.

4. A building module comprising two adjacent, parallel frames comprised of vertical studs, said frames each being approximately the size of the wall of a room, said frames held fixedly spaced apart, an off-the-floor water closet comprising waste discharge conduit means, waste conduit junction means, water closet carrier means disposed between said parallel frames, said water closet carrier means being comprised of front and back structural means, at least one of said front and back structural means connected to provide support for said off-the-floor water closet means, said water closet carrier means adapted to receive said waste conduit junction means within said water closet carrier means, and wherein said waste conduit junction means is connected to said waste discharge conduit means of said off-the-floor water closet, structural means independent of said waste conduit junction means rigidly connecting said front and back structural means with respect to each other, and wherein said independent structural means rigidly holds said front and back structural means apart, with respect to each other, independently of said vertical studs and wherein is included waste conduit means connected to one or more of a bath and a shower and wherein said waste conduit junction means and all of said waste conduit means are disposed above the bottom of said parallel frames and wherein said module has no floor.

5. A building module comprising two adjacent, parallel frames comprised of vertical studs, said frames each being approximately the size of the wall of a room, said frames held fixedly spaced apart, an off-the-floor water closet comprising waste discharge conduit means, waste conduit junction means, water closet carrier means disposed between said parallel frames, said water closet carrier means being comprised of front and back structural means, at least one of said front and back structural means connected to provide support for said off-the-floor water closet means, said water closet carrier means adapted to receive said waste conduit junction means within said water closet carrier means, and wherein said waste conduit junction means is connected to said waste discharge conduit means of said off-the-floor water closet, structural means independent of said waste conduit junction means rigidly connecting said front and back structural means with respect to each other, and wherein said independent structural means rigidly holds said front and back structural means apart, with respect to each other, independently of said vertical studs and wherein said building module comprises flooring structure and wherein said water closet carrier means is attached to said flooring structure.

6. A building module comprising two adjacent, parallel frames comprised of vertical studs, said frames each being approximately the size of the wall of a room, said flames held fixed spaced apart, an off-the-floor water closet comprising waste discharge conduit means, waste conduit junction means, water closet carrier means disposed between said parallel frames, said water closet carrier means being comprised of front and back structural means, at least one of said front and back structural means providing support for said off-the-floor water closet means, said water closet carrier means adapted to receive said waste conduit junction means within said water closet carrier means, said waste conduit junction means connected to said waste discharge conduit means of said off-the-floor water closet, and structural means independent of said waste conduit junction means for rigidly connecting said front and back structural means with respect to each other and wherein said front structural means of said water closet carrier means is comprised of a first plate and wherein said back structural means of said water closet carrier means is comprised of a second plate, and wherein said structural means for rigidly connecting said front and back structural means, are a third and fourth plate, said third plate connected to said first and second plate on one side of said first and second plate and said fourth plate connected to said first and second plate on the other side of said first and second plate.

7. A building module adapted to placed upon flooring structure, said building module comprised of at least four walls forming at least two rooms, and wherein said building module has no floor, said building module being comprised of two parallel frames held fixedly spaced apart and dividing said module into said at least said two rooms, one or more off-the-floor water closets, each having waste discharge conduit means, water closet carrier means disposed between said parallel frames, said water closet carrier means having opposing sides and connected to support said one or more off-the-floor water closets, each attached to an opposing side of said water closet carrier means, waste conduit junction means disposed within said water closet carrier means, said waste conduit junction means being connected to said waste discharge conduit means of said one or more water closets.

8. The building module of claim 6 wherein said independent structural means holds said front and back structural means rigidly apart independently of said studs.

9. The building module of claim 7 wherein said opposite sides of said water closet carrier means are held rigidly apart independently of said parallel frames.

10. The building module of claim 7, wherein is included a main waste discharge conduit, and wherein one or both of said rooms comprise a bath or shower or both, and wherein is included waste discharge conduit means connecting said bath or shower or both to said main waste discharge conduit, and wherein said waste discharge conduit means comprises traps and wherein substantially all of said waste discharge conduit means are above the bottom level of said floorless building module.

11. A building module, said building module comprised of two rooms having a partition therebetween, said partition comprised of two parallel frames held a fixed distance apart, a wall constructed on each of said parallel frames, each said wall forming a wall of each of said rooms, an off-the-floor water closet in at least one of said rooms, a water closet carrier disposed between said parallel frames and connected to provide support for said off-the-floor water closet, and wherein said water closet carrier has front and back plates and two opposing side plates, each connected between said front and back plates.

12. A building module comprising a wall having opposing facts, a water closet carrier comprising a first faceplate and a second faceplate, each adapted to receive and support an off-the-floor water closet, each of said off-the-floor water closets having a waste discharge conduit, connecting plate means connecting said first faceplate to said second faceplate and rigidly holding said first and second faceplates fixedly apart, and wherein said first faceplate is disposed substantially flush with one of said faces of said wall and wherein said second faceplate is disposed substantially flush with the other of said faces.

13. The building module of claim 12 wherein a waste conduit junction is included between said first and second faceplates, and wherein said first and second faceplates each have a hole therethrough, and wherein is included conduits through said holes, said conduits adapted to connect to the waste discharge conduits of said off-the-floor water closets.

14. The building module of claim 13 wherein said waste conduit junction is further connected to one or more approximately horizontal, but slightly sloping waste conduit lines disposed within said wall and a vertical vent conduit disposed within said wall.

15. A building module comprising two rooms, at least one of said rooms having one or more of a bath and a shower, first waste discharge conduit means comprising a trap, said first waste discharge conduit means connected to the bottom of said one or more of a bath and a shower for discharging waste out of said room, said first waste discharge conduit means being substantially entirely disposed above the bottom of said module and wherein is included an approximately horizontal, main waste discharge conduit disposed between said two rooms, said main waste discharge conduit connected to receive waste discharge from both said rooms, said main waste discharge conduit extending slightly downwardly to an accessible location at or near the side of said module and draining waste discharge from said module to said location, and wherein said main waste discharge conduit is connected to receive waste discharge from both said rooms and wherein one of said connections comprises connection to said first waste discharge conduit means, wherein said module has no floor.

* * * * *